US006581385B2

(12) United States Patent
Joos et al.

(10) Patent No.: US 6,581,385 B2
(45) Date of Patent: Jun. 24, 2003

(54) COMBUSTION DEVICE FOR GENERATING HOT GASES

(75) Inventors: Franz Joos, Weilhelm-Bannholz (DE); Wolfgang Polifke, Freising (DE); Alexander Ni, Baden (CH)

(73) Assignee: Alstom, Paris (FR)

( * ) Notice: Subject to any disclaimer, the term of this patent is extended or adjusted under 35 U.S.C. 154(b) by 0 days.

(21) Appl. No.: 10/237,076

(22) Filed: Sep. 9, 2002

(65) Prior Publication Data

US 2003/0041588 A1 Mar. 6, 2003

Related U.S. Application Data

(62) Division of application No. 09/637,866, filed on Aug. 15, 2000, now Pat. No. 6,449,951.

(30) Foreign Application Priority Data

Aug. 18, 1999 (DE) ..... 199 39 235

(51) Int. Cl.[7] ..... F23R 3/00

(52) U.S. Cl. ..... 60/725; 60/746

(58) Field of Search ..... 60/39.37, 725, 60/746, 747; 431/178

(56) References Cited

U.S. PATENT DOCUMENTS

| | | | |
|---|---|---|---|
| 5,471,840 | A | 12/1995 | Lovett |
| 5,687,571 | A | 11/1997 | Althaus et al. |
| 5,901,549 | A | 5/1999 | Mandai et al. |
| 5,943,866 | A | 8/1999 | Lovett et al. |
| 6,269,646 | B1 | 8/2001 | Lovett et al. |

FOREIGN PATENT DOCUMENTS

| | | |
|---|---|---|
| DE | 43 36 096 | 5/1994 |
| DE | 19545 311 | 6/1997 |
| DE | 196 15 910 | 10/1997 |
| DE | 198 09 364 | 9/1998 |
| EP | 0 571 782 | 12/1993 |
| EP | 0 952 392 | 10/1999 |
| JP | 0080028871 | 2/1996 |
| WO | WO98/12478 | 3/1998 |

*Primary Examiner*—Louis J. Casaregola
(74) *Attorney, Agent, or Firm*—Burns, Doane, Swecker & Mathis, L.L.P.

(57) ABSTRACT

In a combustion device (10), particularly for driving gas turbines, comprising a plurality of burners (12, . . . , 15) of identical thermal power output, which work parallel to an axis (28) into a common combustion chamber (11), an effective suppression of thermoacoustic combustion instabilities is achieved in a simple way in that the burners (12, . . . , 15) are designed differently from one another in such a way that the flames (24, . . . , 27) or flame fronts generated by them are positioned so as to be distributed along the axis (28).

4 Claims, 2 Drawing Sheets

COMBUSTION DEVICE FOR GENERATING HOT GASES

Figure 1:
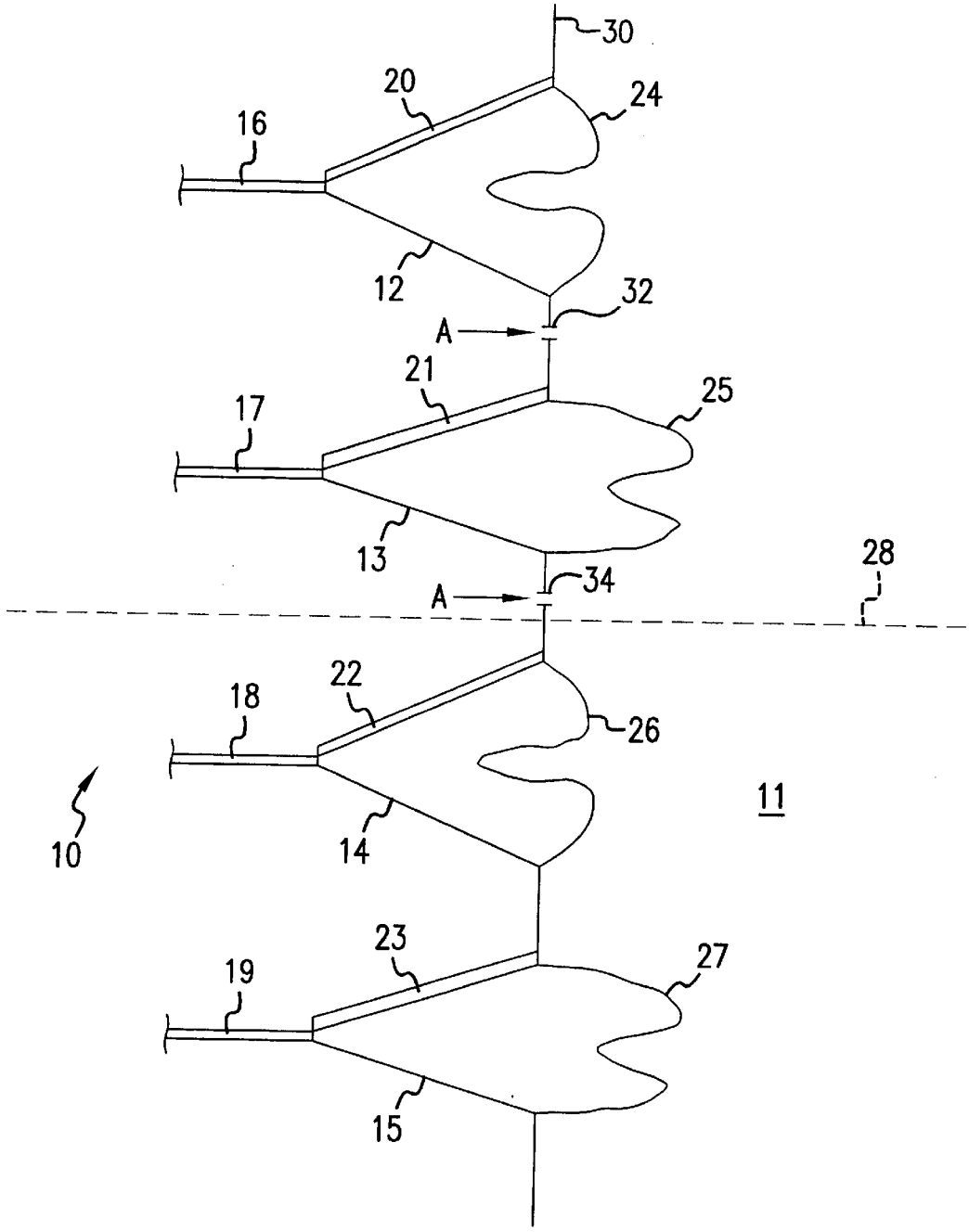

This application is a divisional of application Ser. No. 09/637,866, filed on Aug. 15, 2000 now U.S. Pat. No. 6,449,951.

BACKGROUND OF THE INVENTION

1. Field of the Invention

The present invention relates to the field of combustion technology. It refers to a combustion device, particularly for driving gas turbines, comprising a plurality of burners of identical thermal power output, which work parallel to an axis into a common combustion chamber.

2. Description of the Related Art

Such a combustion device is known, for example, from the applicant's EP-B1-0571782.

Thermoacoustic combustion instabilities may severely impede safe and reliable operation of modern gas turbines with premixing. One of the mechanisms responsible for these instabilities is based on a feedback loop which includes the pressure and velocity fluctuations in the fuel injection, the (convective) fuel inhomogeneities transported by the flow and the heat release rate.

A fundamental stability criterion for the occurrence of thermoacoustic combustion instabilities is the Rayleigh criterion which may be formulated as follows:

As soon as a flame is enclosed in an acoustic resonator, thermoacoustic self-starting oscillations may occur when the following applies $$\int_0^T Q' p' \, dt > 0 \tag{1}$$

Here, Q' is the instantaneous deviation of the integral heat release rate from its mean (stationary) value, p' designates the pressure fluctuations and T designates the period of the oscillations (1/T=f is the frequency of the oscillations). Formula (1) that the spatial extent of the heat release zone is sufficiently small to operate with integral values of Q' and p'. An extension to the more general situation with a distributed heat release Q' (x) and a small acoustic wavelength results directly and leads to a so-called Rayleigh index. The Rayleigh criterion (1) states that an instability can occur only when fluctuations in the heat release and the pressure are in phase with one another at least to a particular degree.

In a combustion device with premixing, the instantaneous heat release rate depends, inter alia, on the instantaneous fuel concentration in the premixed fuel/air mixture which enters the combustion zone. The fuel concentration, in turn, may be influenced by (acoustic) pressure and velocity fluctuations in the vicinity of the fuel injection device, presupposing that the air supply and the fuel injection device are not acoustically rigid. This lastmentioned condition is usually fulfilled, that is to say the pressure drop of the airflow along the fuel injection region of the burner is usually relatively slight, and even the pressure drop along the fuel injection device is generally not sufficient to uncouple the fuel feed line from the acoustics in the combustion device. The relation between the acoustics at the fuel injection device and the heat release in the flow may be formulated by means of the simplest possible explanations as follows:

$$\frac{Q'(t)}{Q} = -\frac{u'(x_1, t-\tau)}{u(x_1)} - \frac{1}{2}\frac{p'(x_1, t-\tau)}{\Delta p} \tag{2}$$

Here, $x_1$ designates the location of fuel injection and u(x) and u' (x) designate the flow velocity and its instantaneous change in time, while $\tau$ is the time delay which expresses the fact that fuel inhomogeneities occurring at the fuel injection device are not detected immediately by the flame, but only after they have been transported from the injection location to the flame front by the mean flow. In a self-igniting combustion device, $\tau$ is determined by the kinetics of the chemical reactions defining the location of the flame. By contrast, in a conventional combustion device with premixing, the flame is anchored by a flame holder which may assume different configurations (bluff body, V-gutter, recirculation zone or the like). The time delay depends in this case on the mean flow velocity and the distance between the injection location and the flame holder. At all events, the time delay may be described approximately by $$\tau = \int_0^l \frac{dx}{U(x)}, \tag{3}$$

l designating the distance between the injection location and the flame front, while U(x) is the mean flow velocity in the premixing zone of the burner with which the fuel inhomogeneities are transported in the flow from the injection device to the flame.

It may be stated, in summary, that equation (2) expresses the fact that an instantaneous increase in the velocity of the air flowing past the fuel injection device (first term on the right side of the equation) leads to a dilution of the fuel/air mixture and a corresponding reduction in the heat release, while a pressure increase at the fuel injection device (second term on the right side of the equation) reduces the instantaneous fuel mass flow and therefore likewise lowers the heat release rate. It may be pointed out that, even when the fuel injection device is acoustically "rigid" (that is to say $\Delta p \rightarrow \infty$), fuel inhomogeneities may be generated at the injection device.

As regards thermoacoustic stability, a time delay, such as occurs in equation (2), generally makes it possible to have a resonant feedback and an intensification of infinitesimal disturbances. The exact conditions and frequencies at which self-starting oscillations occur also depend, of course, on the mean flow conditions, specifically, in particular, the flow velocities and temperatures, and on the acoustics of the combustion device, such as, for example, the boundary conditions, natural frequencies, damping mechanisms, etc. The relation between the acoustic properties and the fluctuations in the heat release, such as is described in equation (2), is nonetheless a threat to the thermoacoustic stability of the combustion device which is to be taken seriously. A way should therefore be found to suppress this mechanism from the outset.

In principle, within the framework of the considerations referred to above, it is conceivable to bring about a suppression of thermoacoustic instabilities by a distribution of different time delays on the time axis. In this case, the injected fuel is divided into two or more individual streams or "parcels" which all have time delays different from one another and correspondingly different phases. Ideally, such a division into various fuel streams would result in fluctuations in the heat release $Q'_i$ (i=1, 2, . . . ), such that $$\sum_i \int_0^T Q_i(t)\,dt = 0 \tag{4}$$

would be applicable. This would ensure that the Rayleigh criterion (1) cannot be fulfilled. In practice, such an exact cancellation is neither possible nor necessary; it is sufficient to lower the intensity of the resonant feedback to an extent such that the dissipative effects within the system are greater than the reinforcing mechanisms.

It was already proposed in the past (DE-A1-198 09 364), within a burner or in a plurality of burners working in parallel into a combustion chamber, to inject fuel in an axially graduated manner at different axial distances from the location of heat release. Part quantities of the fuel are thus transported with convective delay times of differing length from the location of injection to the flame, thus resulting in unequal phase relationships and therefore an attenuation of the resonant feedback. Such a solution has the disadvantage, however, that fuel injection is comparatively complicated in terms of apparatus because of the axial graduation: to be precise, if axially graduated injection takes place within a burner, it is necessary to have a plurality of separate injection orifices located one behind the other. If, on the other hand, a plurality of parallel burners are used with different axial injection locations, the burners have to be manufactured individually because of their different configuration, thus making production and stockkeeping considerably more expensive. At all events, in the case of fuel injection which is far upstream, there is also the increased risk of a so-called flame flashback which may lead to thermal overloading and destruction of the burner.

Other solutions, known from the prior art, to the problem of combustion instabilities relate to the distribution of the heat release along the axis of the combustion device by the generated flames or flame fronts being positioned so as to be distributed axially. U.S. Pat. No. 5,471,840 proposes, in this respect, to arrange at the individual burner, in each case on the outlet side, additional flame holders which displace part of the combustion (or flame fronts) upstream out of the combustion chamber into the flow pipe of the burner. A disadvantage of this, however, is that each burner has to be equipped with the flame holders. Another disadvantage is that the flame holders are subjected to high thermal load and therefore have to be cooled in a very complicated way and manufactured from material (ceramic) resistant to high temperature. Problems nonetheless arise with regard to long-term strength.

By contrast, it is proposed in U.S. Pat. No. 5,901,549 to use a pilot burner operating asymmetrically with respect to the axis, in order to generate longer and shorter flames at the adjacent premixing burners. One disadvantage of this is, above all, that a pilot burner operates in the diffusion mode, therefore generates high NOx emissions and consequently cannot be used in the full-load mode. Another disadvantage is that the pilot burner plays a central part in suppressing the combustion instabilities, so that disturbances in the pilot burner impair the functioning of the system as a whole. Furthermore, the necessary interaction between the pilot burner and the other burners is difficult to set and optimize.

SUMMARY OF THE INVENTION

The object of the invention, therefore, is to design a combustion device of the type initially mentioned in such a way that combustion instabilities are suppressed in a simple and functionally reliable way.

The essence of the invention is that the burners themselves are designed differently in such a way that the flames or flame fronts generated by them assume different axial positions and the heat release is thus distributed along the axis. The different design of the individual burners can be carried out without difficulty and with simple means and is feasible in the most diverse types of burners, without the need for complicated accessories. In particular, the parameters characteristic of the burner behavior may be selected differently from burner to burner, in order to obtain a corresponding axial flame distribution. An important advantage, in this case, is that all the burners used can be designed as premixing burners, so that this solution is compatible with a full load and entails virtually no disadvantages as regards NOx emission.

A preferred embodiment of the combustion device according to the invention is characterized in that the burners are designed as swirl-stabilized premixing burners, and in that the different axial position of the flames is brought about by a different swirl coefficient of the individual burners. Preferably, at the same time, the burners are designed as double-cone burners, into which the combustion air is injected in each case through slits formed between the cones; the different swirl coefficient is determined by the width of the slits and the aperture angle of the cones.

According to another preferred embodiment with swirl-stabilized premixing burners, the different axial position of the flames is brought about by the additional injection of air at the inlet and/or outlet of the burners. It is also possible, however, that, at the burners, the fuel is injected through injection orifices arranged in a distributed manner, and that the different axial position of the flames is brought about by a different arrangement and size of the injection orifices, or that the burners each have an outlet to the combustion chamber, and that the different axial position of the flames is brought about by a different configuration of the outlets.

Another preferred embodiment of the invention is distinguished in that the burners are designed as secondary burners, and in that a different axial position of the flames is produced in that the burners are equipped partially with a diffuser at their outlet to the combustion chamber and open into the combustion chamber partially without a diffuser.

BRIEF DESCRIPTION OF THE DRAWING FIGURES

Figure 2:
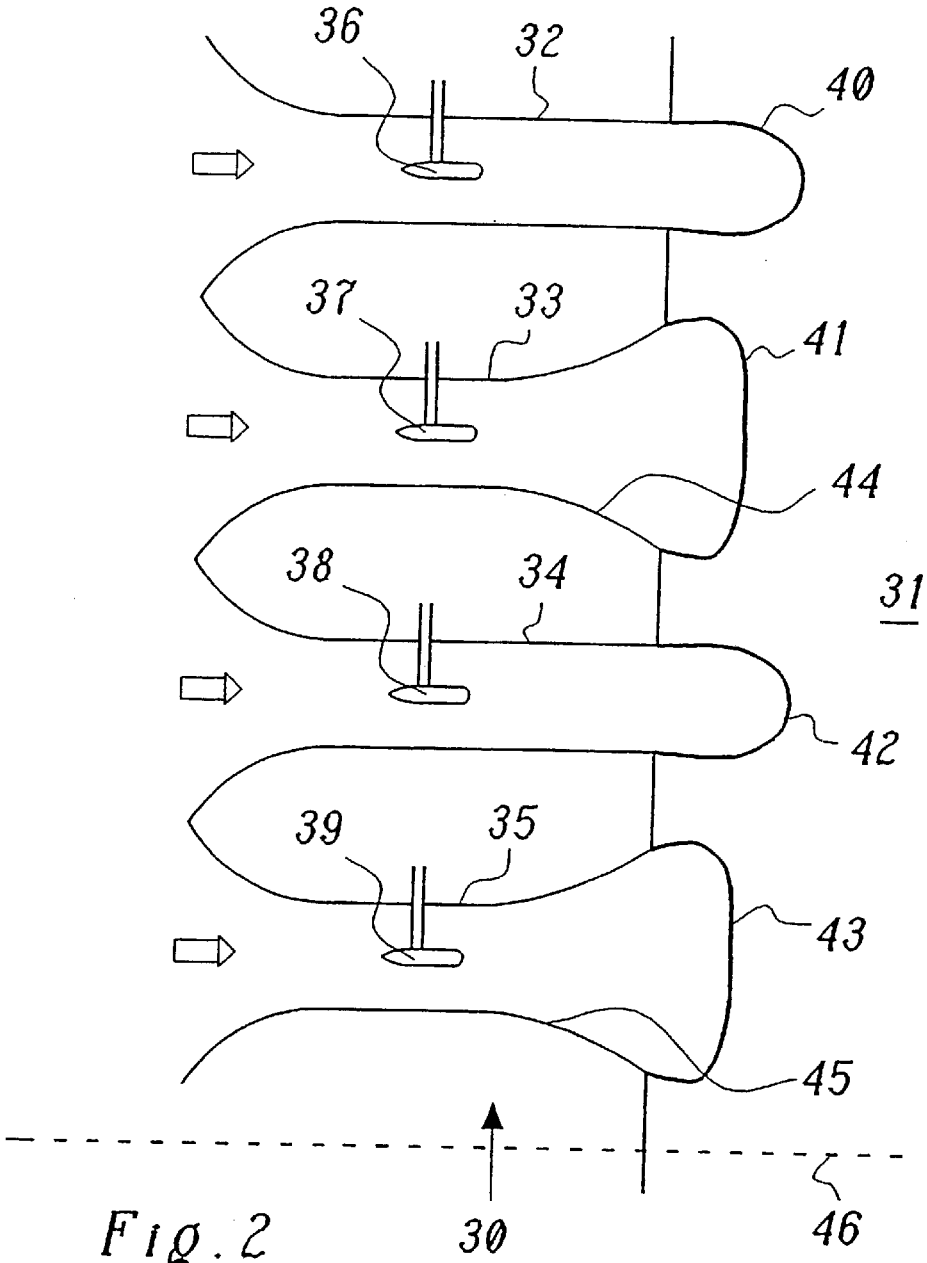

The invention will be explained in more detail below with reference to exemplary embodiments in conjunction with the drawing in which:

FIG. 1 shows a diagrammatic sectional illustration of a combustion device with an arrangement of double-cone burners, in which, according to a preferred exemplary embodiment of the invention, a different swirl coefficient is generated by a different choice of the aperture angles and slit widths; and FIG. 2 shows an illustration, comparable to that of FIG. 1, of a second preferred exemplary embodiment of the invention, with secondary burners in which differently positioned flame fronts are generated by means of differently configured burner outlets (with and without a diffuser).

DETAILED DESCRIPTION OF THE PREFERRED EMBODIMENT

FIG. 1 reproduces a diagrammatic cross-sectional illustration of a preferred exemplary embodiment of a combustion device 10 according to the invention. The combustion device 10 comprises, in a comparable way to FIG. 1 of EP-B1-0 571 782, a plurality of burners 12, . . . , 15 (illustrated in simplified form) in the form of so-called double-cone or EV burners, such as are used in the applicant's gas turbine plants. The burners 12, . . . , 15 have an internal construction and a mode of functioning which may be gathered, for example, from FIG. 7 of EP-B1-0 571 782. They operate in parallel with one another and with an axis 28 into a combustion chamber 11. In each burner 12, . . . , 15, liquid and/or gaseous fuel is supplied via a fuel supply 16, . . . , 19 and is injected centrally or tangentially into the interior of the cone which is open toward the combustion chamber 11. Combustion air enters the cone from outside likewise tangentially through corresponding slits 20, . . . , 23 and is intermixed with the fuel, to form a vortex. The burners 12, . . . , 15 therefore constitute swirl-stabilized premixing burners. The fuel/air vortex formed in the burners 12, . . . , 15 extends into the combustion chamber 11 and ignites there to form and maintain a flame 24, . . . , 27 with the corresponding flame front.

The axial position of the flames 24, . . . , 27 or flame fronts and consequently the axial position of the heat release in the combustion device 10 is determined, in the illustrative double-cone burners 12, . . . , 15 of FIG. 1, by:

- the swirl coefficient which is determined, in turn, by the aperture angle of the burner cone and the width of the slits 20, . . . , 23;
- the injection of head air or blast air at the tip of the burner cone;
- the shape of the burner outlet to the combustion chamber 11 (a Coanda diffuser may, for example, be provided here, which "utilizes" a recirculation zone at the burner outlet);
- the arrangement of mechanical flame holders at the burner outlet (for example, tetrahedral vortex generating elements);
- the injection of air transversely to the main flow at the burner outlet; and
- the arrangement and size of the injection orifices for the fuel.

If one or more of these parameters are varied from burner to burner, this results, for each of the burners 12, . . . , 15, in a different position of the flame 24, . . . , 27 or flame front and consequently an axially distributed time delay along the lines of the statements made initially. In the example of FIG. 1, the burners 13 and 15 have a wider slit 23 and a smaller aperture angle than the burners 12 and 14. The result of this is that the flames 25 and 27 of these burners project further in the axial direction into the combustion chamber 11 than the flames 24 and 26. An axial distribution of the flame fronts and therefore also the heat release is consequently obtained, by means of which the thermoacoustic combustion instabilities are impeded or completely prevented. As illustrated in FIG. 1, the different axial position of the flames can also be brought about by the injection of air at the outlet of the burners through orifices 32, 34 in a front panel 30, as represented by arrows A, in addition to the combustion air premixed with fuel by said premixing burners. While the example of FIG. 1 illustrates only two different axial flame positions, it is possible and may be expedient to produce a multiplicity of different positions by a wider-ranging variation in the parameters. In burners different from double-cone burners, correspondingly different parameters must influence the flame position and be varied from burner to burner according to the invention.

Another exemplary embodiment of the invention is illustrated diagrammatically in FIG. 2. The combustion device 30 shown in FIG. 2 likewise comprises a plurality of burners 32, . . . , 35 which, in this case, are designed as secondary burners (see, for example, U.S. Pat. No. 5,431,018) and are used by the applicant under the designation SEV burners in gas turbine plants. The burners 32, . . . , 35 are connected in parallel to one another and to an axis 46 and work into a common combustion chamber 31. Each of the burners 32, . . . , 35 receives on the inlet side, from a preceding combustion chamber and turbine stage, hot combustion gases, into which fuel and, if appropriate, air are injected by means of an injection device 36, . . . , 39 located in the flow. The mixture which forms downstream of the injection device 36, . . . , 39 flows into the combustion chamber 31 where a flame 40, . . . , 43 is produced by self-ignition. In this secondary burner arrangement too, a distribution of the flame positions along the axis 46 is achieved by means of a different configuration of the individual burners. For this purpose, in the case of the burners 33 and 35, diffusers 44, 45 are provided on the outlet side, in contrast to the burners 32 and 34. The widening diffusers 44 and 45 ensure that wider and shorter flames 41, 43 are formed than in the burners 32, 34 without special diffusers. This results in an axial distribution of the flame positions and, correspondingly, of the heat release.

We claim:

1. A combustion device comprising a plurality of burners of identical thermal power output, which are arranged in parallel to an axis into a common combustion chamber, the burners being swirl-stabilized premixing burners that deliver premixed fuel and combustion air to a combustion zone, wherein the flames or flame fronts generated by the burners are positioned so as to be distributed along the axis, wherein the different axial position of the flames is brought about by devices adapted to inject air at the inlet and/or outlet of the burners in addition to the combustion air premixed with fuel by said premixing burners.

2. The combustion device as claimed in claim 1 in combination with a gas turbine, wherein hot combustion gas produced by the combustion of said premixed fuel and combustion air in said combustion zone drives said gas turbine.

3. A combustion device, comprising:

a plurality of burners of substantially similar thermal power output, which are arranged in parallel to an axis of a common combustion chamber, the burners being swirl-stabilized premixing burners that deliver premixed fuel and combustion air to a combustion zone, each of said burners being aligned along a common axis and including means for generating flames or flame fronts such that the flames or flame fronts generated by each of said burners are positioned so as to be distributed differently along the axis of the common combustion chamber, wherein the different axial position of the flames is brought about by devices adapted to inject air at the inlet and/or outlet of the burners in addition to the combustion air premixed with fuel by said premixing burners.

4. The combustion device as claimed in claim 3 in combination with a gas turbine, wherein hot combustion gas produced by the combustion of said premixed fuel and combustion air in said combustion zone drives said gas turbine.

* * * * *